US008662958B2

(12) United States Patent
Ahn et al.

(10) Patent No.: US 8,662,958 B2
(45) Date of Patent: Mar. 4, 2014

(54) CHEMICAL-MECHANICAL POLISHING APPARATUS FOR MANUFACTURING SEMICONDUCTOR DEVICES

(75) Inventors: Jong-sun Ahn, Hwaseong-si (KR); In-seak Hwang, Suwon-si (KR); Soo-young Tak, Suwon-si (KR); Shin Kim, Hwaseong-si (KR); One-moon Chang, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 517 days.

(21) Appl. No.: 12/985,048

(22) Filed: Jan. 5, 2011

(65) Prior Publication Data

US 2011/0171882 A1 Jul. 14, 2011

(30) Foreign Application Priority Data

Jan. 11, 2010 (KR) ..... 10-2010-0002392

(51) Int. Cl.
*B24B 49/00* (2012.01)

(52) U.S. Cl.
USPC ..... 451/8; 451/285; 451/159

(58) Field of Classification Search
USPC ..... 451/6, 8, 159, 285–291
See application file for complete search history.

(56) References Cited

U.S. PATENT DOCUMENTS

| | | | | |
|---|---|---|---|---|
| 5,975,997 | A * | 11/1999 | Minami | 451/287 |
| 6,379,235 | B1 * | 4/2002 | Halley | 451/397 |
| 2002/0013122 | A1 * | 1/2002 | Sugaya et al. | 451/41 |

FOREIGN PATENT DOCUMENTS

| | | |
|---|---|---|
| JP | 08-197410 | 8/1996 |
| JP | 11-054467 | 2/1999 |
| KR | 1020020006272 A | 1/2002 |

* cited by examiner

*Primary Examiner* — Maurina Rachuba
(74) *Attorney, Agent, or Firm* — Myers Bigel Sibley & Sajovec, PA

(57) ABSTRACT

A chemical-mechanical polishing (CMP) apparatus for manufacturing a semiconductor device. The apparatus includes: a spin chuck for supporting and rotating a semiconductor wafer; a polisher comprising a polishing pad for planarizing a surface of the semiconductor wafer, the polisher moving along the surface of the semiconductor wafer by a polishing arm; and a polisher supporting device for supporting the polisher and maintaining the polisher in a horizontal state, while polishing an edge part of the surface of the semiconductor wafer, in order to improve polishing uniformity of a center part and the edge part of the semiconductor wafer. Accordingly, polishing uniformity of the center part and edge part of the semiconductor wafer may be improved, and a height of the polisher supporting device may be optimized according to a polishing degree. Also, the polisher may be easily supported, wear and tear of the support head may be minimized, and the support head may function as a conditioner.

19 Claims, 5 Drawing Sheets

CHEMICAL-MECHANICAL POLISHING APPARATUS FOR MANUFACTURING SEMICONDUCTOR DEVICES

CROSS-REFERENCE TO RELATED APPLICATION

This application claims the benefit of Korean Patent Application No. 10-2010-0002392, filed on Jan. 11, 2010, in the Korean Intellectual Property Office, the disclosure of which is incorporated herein in its entirety by reference.

BACKGROUND

The inventive concept relates to a chemical-mechanical polishing (CMP) apparatus for manufacturing a semiconductor device.

In a general face-up type CMP apparatus, a spin chuck supports a non-polished surface of a wafer by vacuum adsorbing the non-polished surface so as for a polished surface of the wafer to face upward, and a polisher moves along the wafer surface to polish the wafer surface. The CMP apparatus may actively correspond to the wafer surface since a rotational axis of the polisher may be inclined, that is, may be naturally or intentionally tilted, within an allowable range.

Such a polisher polishes the wafer surface by moving along the wafer surface. While the polisher polishes the center part of the wafer surface, a uniform wafer pressure is exerted to the entire polisher from the wafer and thus the polisher may be maintained in a horizontal state. However, when a part of the polisher is out of an edge part of the wafer surface in order to polish the edge part of the wafer surface, the rotational axis of the polisher is tilted in an edge part direction due to an unbalanced pressure and thereby the polisher may not maintain its horizontal state and is tilted. Thus, a polishing pad of the tilted polisher and the wafer that rotates in a horizontal state collide with each other and thereby the edge part of the wafer contacted due to the collision is severely damaged. Consequently, polishing uniformity of the center part and edge part of the wafer surface is deteriorated.

SUMMARY

The inventive concept provides a chemical mechanical polishing (CMP) apparatus for manufacturing a semiconductor device which may improve polishing uniformity of a center part and edge part of a wafer surface by supporting a part of a polisher, which polishes the edge part of the wafer, using a polisher supporting device so as to maintain a horizontal state of the polisher.

The inventive concept also provides a CMP apparatus for manufacturing a semiconductor device which may optimize a height of a polisher supporting device according to a polishing degree, by accurately controlling the height of the polisher supporting device using a height measuring sensor and an ascent/descent device.

The inventive concept also provides a CMP apparatus for manufacturing a semiconductor device which facilitates supporting of a polisher by forming an inclined surface, a de-ionized water (DIW) injection hole, or a roller in a support head, and which minimizes a damage to the support head.

The inventive concept also provides a CMP apparatus for manufacturing a semiconductor device in which a conditioning pad is installed to a support head so as to remove foreign substances of a polisher head so that a polisher supporting device may function as a conditioner.

According to an aspect of the inventive concept, there is provided a chemical-mechanical polishing (CMP) apparatus for manufacturing a semiconductor device, the apparatus including; a spin chuck for supporting and rotating a semiconductor wafer; a polisher comprising a polishing pad for planarizing a surface of the semiconductor wafer, the polisher moving along the surface of the semiconductor wafer by a polishing arm; and a polisher supporting device for supporting the polisher and maintaining the polisher in a horizontal state, while polishing an edge part of the surface of the semiconductor wafer, in order to improve polishing uniformity of a center part and the edge part of the semiconductor wafer.

The polisher supporting device may include: a support head installed near to the spin chuck to have the same height as the surface of the semiconductor wafer so as to contact and support a part of the polishing pad of the polisher, which is out of the semiconductor wafer, while polishing the edge part of the semiconductor wafer; and an ascent/descent device for ascending and descending the support head so as to control a height of the support head.

The support head may include a contact surface contacting the polishing pad of the polisher or a contact surface contacting the polishing pad of the polisher, and an inclined surface guiding the polishing pad to the contact surface.

The support head may include a conditioning pad which removes foreign substances of the polishing pad of the polisher.

The support head may include a de-ionized water (DIW) injection hole which supplies DIW to the polishing pad of the polisher, the DIW injection hole comprising a pressure controlling valve.

The support head may include a round shape contact surface contacting the polishing pad of the polisher.

The support head may include a bearing ball rolling and contacting the polishing pad of the polisher.

The support head may include a roller rolling and contacting the polishing pad of the polisher.

The apparatus may further include: a height measuring sensor for measuring a height of the support head; and a controller for receiving a height signal of the height measuring sensor and applying a control signal to the ascent/descent device.

The apparatus may further include a rotating device installed between the ascent/descent device and the support head for rotating the support head.

The spin chuck may be a face up type which vacuum adsorbs and supports a non-polished surface of the semiconductor wafer so as for a polished surface of the semiconductor wafer to face upward.

BRIEF DESCRIPTION OF THE DRAWINGS

Exemplary embodiments of the inventive concept will be more clearly understood from the following detailed description taken in conjunction with the accompanying drawings in which.

DETAILED DESCRIPTION OF THE EMBODIMENTS

Figure 1:
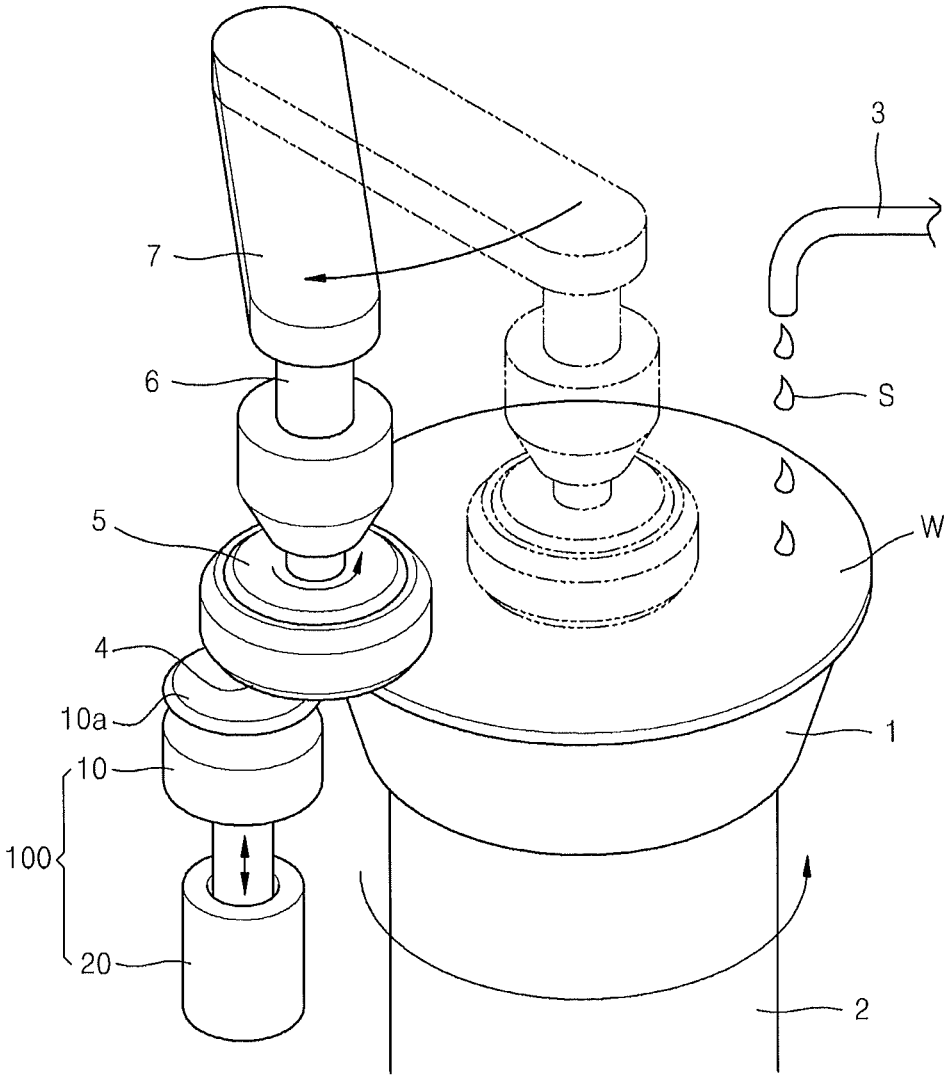
FIG. 1 is a perspective view of a chemical-mechanical polishing (CMP) apparatus for manufacturing a semiconductor device, according to an embodiment of the inventive concept.

Various example embodiments according to the inventive concept will be described more fully hereinafter with reference to the accompanying drawings, in which some example embodiments according to the inventive concept are shown. The present inventive concept may, however, be embodied in many different forms and should not be construed as limited to the example embodiments according to the inventive concept set forth herein. Rather, these example embodiments according to the inventive concept are provided so that this description will be thorough and complete, and will fully convey the scope of the present inventive concept to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, fourth etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive concept.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments according to the inventive concept only and is not intended to be limiting of the present inventive concept. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments according to the inventive concept are described herein with reference to cross-sectional illustrations that are schematic illustrations of idealized example embodiments according to the inventive concept (and intermediate structures). As such, variations from the shapes of the illustrations as a result, for example, of manufacturing techniques and/or tolerances, are to be expected. Thus, example embodiments according to the inventive concept should not be construed as limited to the particular shapes of regions illustrated herein but are to include deviations in shapes that result, for example, from manufacturing. Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, a chemical-mechanical polishing (CMP) apparatus for manufacturing a semiconductor device, according to embodiments of the inventive concept, will be described more fully with reference to the accompanying drawings.

Figure 2:
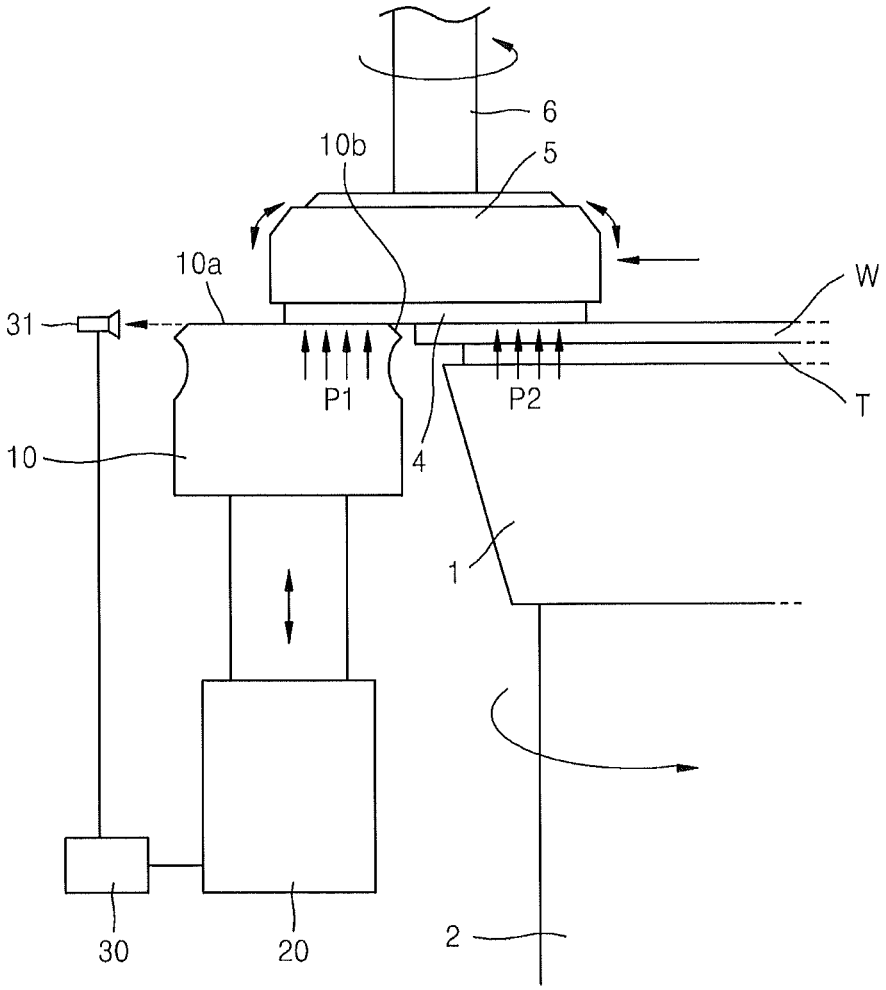
FIG. 2 is a side view of the CMP apparatus of FIG. 1.

FIG. 1 is a perspective view of a CMP apparatus for manufacturing a semiconductor device, according to an embodiment of the inventive concept, and FIG. 2 is a side view of the CMP apparatus of FIG. 1.

Referring to FIGS. 1 and 2, the CMP apparatus for manufacturing a semiconductor device, according to the current embodiment of the inventive concept, may include a spin chuck 1, a slurry supply pipe 3, a polisher 5, and a polisher supporting device 100.

Here, the spin chuck 1 vacuum adsorbs and supports a semiconductor wafer W, on which a backside tape T is attached, and rotates the semiconductor wafer W with respect to a rotational axis 2. The spin chuck 1 may be a face-up type which vacuum adsorbs and supports a non-polished surface of the semiconductor wafer W so as for a polished surface of the semiconductor wafer W to face upward.

Also, as illustrated in FIG. 1, the slurry supply pipe 3 supplies slurry S to the semiconductor wafer W, wherein the slurry S chemically and mechanically polishes the polished surface of the semiconductor wafer W.

In addition, as illustrated in FIG. 1, the polisher 5 includes a polishing pad 4, which polishes the surface of the semiconductor wafer W and chemically and physically planarizes the surface of the semiconductor wafer W, and moves along the surface of the semiconductor wafer W by a polishing arm 7 while rotating about a polishing rotational axis 6.

Accordingly, the polisher 5 moves along the surfaces of the semiconductor wafer W, for example, from the center part of the semiconductor wafer W to the edge part of the semiconductor wafer W, and thereby, polishes the surface of the semiconductor wafer W.

As illustrated in FIGS. 1 and 2, in order to improve polishing uniformity of the center part and edge part of the semiconductor wafer W, the polisher supporting device 100 according to the present inventive concept supports the polisher 5 with a supporting pressure P1 that corresponds to a wafer pressure P2, while polishing the edge part of the semiconductor wafer W, and maintains the polisher 5 in a horizontal state. The polisher supporting device 100 may include a support head 10 and an ascent/descent device 20.

The support head 10 is installed near to the spin chuck 1 to have the same height as the surface of the semiconductor wafer W so that the support head 10 may contact a part of the polishing pad 4 of the polisher 5 which is out of the semiconductor wafer W, while polishing the edge part of the semiconductor wafer W.

Also, as illustrated in FIG. 2, the support head 10 may include a contact surface 10*a* and an inclined surface 10*b*, wherein the contact surface 10*a* contacts the polishing pad 4 of the polisher 5 and the inclined surface 10*b* guides the polishing pad 4 to the contact surface 10*a*.

Accordingly, as illustrated in FIG. 2, although the polisher 5 is out of the semiconductor wafer W, while polishing the edge part of the semiconductor wafer W, the polisher 5 is supported with the supporting pressure P1 by the support head 10 and thus is maintained in a horizontal state without being tilted. Thus, the polisher 5 may evenly polish the edge part of the semiconductor wafer W.

Here, the normal force based on the supporting pressure P1 illustrated in FIG. 2 may be the same as the normal force based on the wafer pressure P2.

That is, when the polisher 5 is inclined and tilted to the left due to lack of the supporting pressure P1, in FIG. 2, the edge part of the semiconductor wafer W contacts the polishing pad 4 of the polisher 5 too much and thus the edge part of the semiconductor wafer W is severely damaged.

On the other hand, when the polisher 5 is inclined and tilted to the right due to excessive supporting pressure P1, in FIG. 2, the center part of the semiconductor wafer W contacts the polishing pad 4 of the polisher 5 too much and thus the center part of the semiconductor wafer W is severely damaged.

Accordingly, the ascent/descent device 20 is needed to control the supporting pressure P1.

That is, the ascent/descent device 20 ascends and descends the support head 10 in order to control a height of the support head 10 and may be any actuator using a motor, or oil pressure or pneumatic cylinder/piston.

Also, as illustrated in FIG. 2, the CMP apparatus for manufacturing a semiconductor device may further include a height measuring sensor 31 and a controller 30, wherein the height measuring sensor 31 measures a height of the support head 10 and the controller 30 receives a height signal from the height measuring sensor 31 to apply a control signal to the ascent/descent device 20.

Here, any height measuring sensor using various types of optical sensors or magnetic sensors may be used as the height measuring sensor 31. For example, a height measuring camera using the naked eye or an image recognition program may be used.

Accordingly, an operation of the CMP apparatus for manufacturing a semiconductor device, according to the current embodiment of the inventive concept, may be described as follows. As illustrated in FIG. 2, the a height of the support head 10 is measured by using the height measuring sensor 31 so that the normal force based on the supporting pressure P1 is the same as the normal force based on the wafer pressure P2. When the height of the support head 10 is lower than a height of the semiconductor wafer W and thus the supporting pressure P1 is insufficient, the controller 30 applies an ascent control signal to the ascent/descent device 20 so as to ascend the support head 10 and thus the polisher 5 may be maintained in a horizontal state.

Also, when the height of the support head 10 is higher than the height of the semiconductor wafer W and thus the supporting pressure P1 is excessive, the controller 30 applies a descent control signal to the ascent/descent device 20 so as to descend the support head 10 and thus a the polisher 5 may be maintained in a horizontal state.

In controlling the height of the support head 10 by the controller 30, the height of the semiconductor wafer W may be gradually lowered while being polished and the height of the support head 10 may also be gradually lowered by being polished so that such a controlling may be fed back in real-time and performed.

Figure 3:
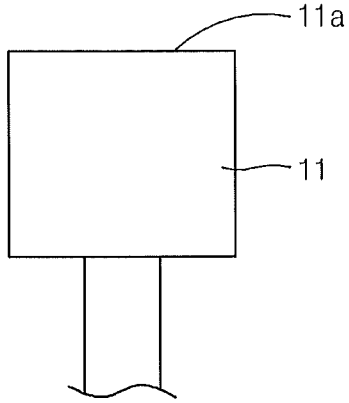
FIG. 3 is a side cross-sectional view of a polisher supporting device of FIG. 1, according to another embodiment of the inventive concept.
Figure 4:
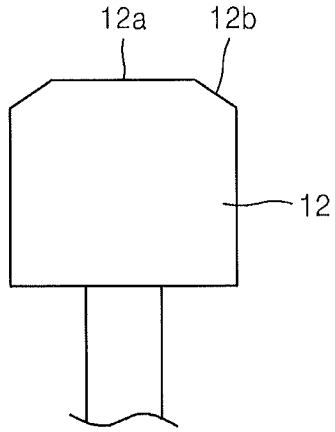
FIG. 4 is a side cross-sectional view of the polisher supporting device of FIG. 3, according to another embodiment of the inventive concept.

As illustrated in FIG. 3, a support head 11 may include a contact surface 11*a* contacting the polishing pad 4 of the polisher 5. Also, as illustrated in FIG. 4, a support head 12 may include a contact surface 12*a* contacting the polishing pad 4 of the polisher 5 and an inclined surface 12*b* guiding the polishing pad 4 to the contact surface 12*a*. Accordingly, when the polisher 5 approaches the support head 12, the polisher 5 does not directly collide with the support head 12 and instead is guided along the inclined surface 12*b*, thereby softly contacting the contact surface 12*a* of the support head 12.

Figure 5:
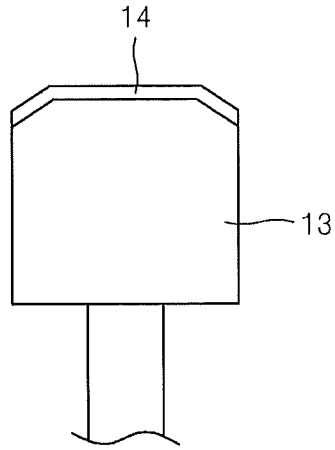
FIG. 5 is a side cross-sectional view of the polisher supporting device of FIG. 3, according to another embodiment of the inventive concept.

As illustrated in FIG. 5, a support head 13 may include a conditioning pad 14 that removes foreign substances of the polishing pad 4 of the polisher 5. Thus, the support head 13 may support the polisher 5 and conditions the polishing pad 4 of the polisher 5 so that polishing capability of the polishing pad 4 is refreshed and maintained.

Figure 6:
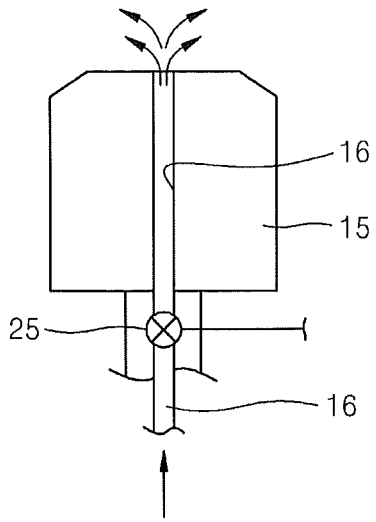
FIG. 6 is a side cross-sectional view of the polisher supporting device of FIG. 3, according to another embodiment of the inventive concept.

As illustrated in FIG. 6, a support head 15 may include a de-ionized water (DIW) injection hole 16 which supplies DIW to the polishing pad 4 of the polisher 5 and thus applies DIW to the polisher 5. An injection pressure of the DIW injection hole 16 is controlled by using a pressure controlling valve 25 so that the support head 15 may support the polisher 5 only with an injection pressure of the DIW injection hole 16, and without directly contacting the polisher 5.

Figure 7:
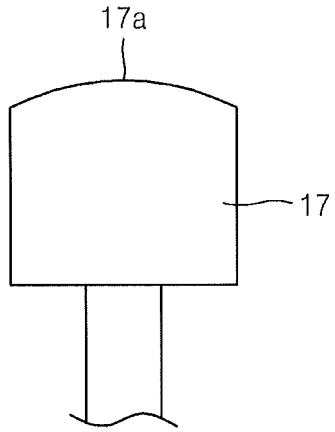
FIG. 7 is a side cross-sectional view of the polisher supporting device of FIG. 3, according to another embodiment of the inventive concept.

As illustrated in FIG. 7, a support head 17 may include a round shape contact surface 17*a* contacting the polishing pad 4 of the polisher 5 in order to reduce a contact surface with the polisher 5 and to minimize friction between the polisher 5 and the support head 17.

Figure 8:
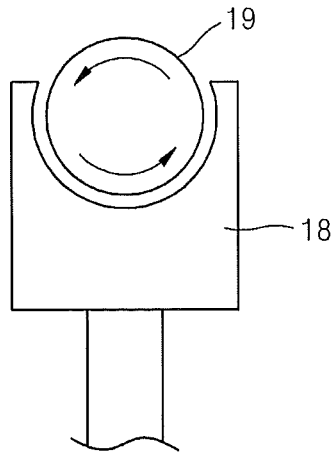
FIG. 8 is a side cross-sectional view of the polisher supporting device of FIG. 3, according to another embodiment of the inventive concept.
Figure 9:
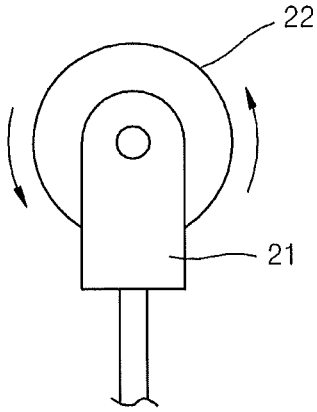
FIG. 9 is a side cross-sectional view of the polisher supporting device of FIG. 3, according to another embodiment of the inventive concept.

As illustrated in FIG. 8, a support head 18 may include a bearing ball 19 rolling and contacting the polishing pad 4 of the polisher 5 in order to minimize friction between the polisher 5 and the support head 18. Also, as illustrated in FIG. 9, a support head 21 may include a roller 22 rolling and contacting the polishing pad 4 of the polisher 5.

Figure 10:
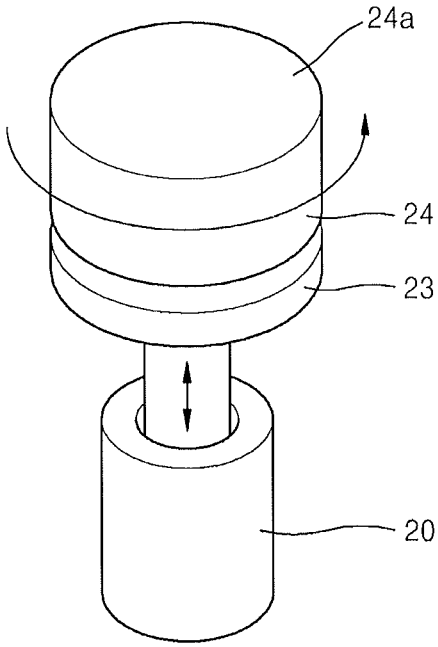
FIG. 10 is a side cross-sectional view of the polisher supporting device of FIG. 3, according to another embodiment of the inventive concept.

As illustrated in FIG. 10, a rotating device 23, which rotates a support head 24, may be installed between the ascent/descent device 20 and the support head 24.

Accordingly, as illustrated in FIG. 10, the support head 24 may support the polisher 5 of FIG. 1 and conditions the polishing pad 4 of the polisher 5 while a contact surface 24*a* is rotated by the rotating device 23 and causes friction with the polishing pad 4 of the polisher 5. Also, the support head 24 may be uniformly worn to have a uniform height.

According to the CMP apparatus for manufacturing a semiconductor device, according to the embodiments of the inventive concept, polishing uniformity of the center part and edge part of the semiconductor wafer surface may be improved and a height of the polisher supporting device may be optimized in real-time according to a polishing degree. Also, wear and tear of the support head may be minimized and the support head may function as a conditioner.

While the inventive concept has been particularly shown and described with reference to exemplary embodiments thereof, it will be understood that various changes in form and details may be made therein without departing from the spirit and scope of the following claims.

What is claimed is:

1. A chemical-mechanical polishing (CMP) apparatus for manufacturing a semiconductor device, the apparatus comprising:

a spin chuck for supporting and rotating a semiconductor wafer;

a polisher comprising a polishing pad for planarizing a surface of the semiconductor wafer, the polisher configured to move along the surface of the semiconductor wafer by a polishing arm; and a polisher supporting device for supporting the polisher and maintaining the polisher in a horizontal state, while polishing an edge part of the surface of the semiconductor wafer, in order to improve polishing uniformity of a center part and the edge part of the semiconductor wafer, wherein the polisher supporting device comprises:

a support head installed near to the spin chuck to have the same height as the surface of the semiconductor wafer so as to contact and support a part of the polishing pad of the polisher, which is out of the semiconductor wafer, while polishing the edge part of the semiconductor wafer; and an ascent/descent device for ascending and descending the support head so as to control a height of the support head while the polisher is polishing the semiconductor wafer.

2. The apparatus of claim 1, wherein the support head comprises a contact surface for contacting the polishing pad of the polisher.

3. The apparatus of claim 1, wherein the support head comprises a contact surface for contacting the polishing pad of the polisher, and an inclined surface for guiding the polishing pad to the contact surface.

4. The apparatus of claim 1, wherein the support head comprises a conditioning pad which removes foreign substances of the polishing pad of the polisher.

5. The apparatus of claim 1, wherein the support head comprises a de-ionized water (DIW) injection hole which supplies DIW to the polishing pad of the polisher, the DIW injection hole comprising a pressure controlling valve.

6. The apparatus of claim 1, wherein the support head comprises a round shape contact surface for contacting the polishing pad of the polisher.

7. The apparatus of claim 1, wherein the support head comprises a bearing ball for rolling and contacting the polishing pad of the polisher.

8. The apparatus of claim 1, wherein the support head comprises a roller for rolling and contacting the polishing pad of the polisher.

9. The apparatus of claim 1, further comprising:

a height measuring sensor for measuring a height of the support head; and a controller for receiving a height signal of the height measuring sensor and applying a control signal to the ascent/descent device.

10. The apparatus of claim 9, wherein the height measuring sensor is a height measuring camera.

11. The apparatus of claim 1, further comprising a rotating device installed between the ascent/descent device and the support head for rotating the support head.

12. The apparatus of claim 1, wherein the spin chuck is a face up type which vacuum adsorbs and supports a non-polished surface of the semiconductor wafer so as for a polished surface of the semiconductor wafer to face upward.

13. A chemical-mechanical polishing (CMP) apparatus for manufacturing a semiconductor device, the apparatus comprising:

a spin chuck for supporting and rotating a semiconductor wafer;

a polisher comprising a polishing pad for planarizing a surface of the semiconductor wafer, the polisher configured to move along the surface of the semiconductor wafer by a polishing arm;

a polisher supporting device for supporting the polisher and maintaining the polisher in a horizontal state, while polishing an edge part of the surface of the semiconductor wafer, in order to improve polishing uniformity of a center part and the edge part of the semiconductor wafer, wherein the polisher supporting device comprises:

a support head installed near to the spin chuck to have the same height as the surface of the semiconductor wafer so as to contact and support a part of the polishing pad of the polisher, which is out of the semiconductor wafer, while polishing the edge part of the semiconductor wafer; and an ascent/descent device for ascending and descending the support head so as to control a height of the support head while the polisher is polishing the semiconductor wafer;

wherein the support head comprises a contact surface for contacting the polishing pad of the polisher, and an inclined surface for guiding the polishing pad to the contact surface.

14. A chemical-mechanical polishing (CMP) apparatus for manufacturing a semiconductor device, the apparatus comprising:

a spin chuck for supporting and rotating a semiconductor wafer;

a polisher comprising a polishing pad for planarizing a surface of the semiconductor wafer, the polisher configured to move along the surface of the semiconductor wafer by a polishing arm;

a polisher supporting device for supporting the polisher and maintaining the polisher in a horizontal state, while polishing an edge part of the surface of the semiconductor wafer, in order to improve polishing uniformity of a center part and the edge part of the semiconductor wafer, wherein the polisher supporting device comprises:

a support head installed near to the spin chuck to have the same height as the surface of the semiconductor wafer so as to contact and support a part of the polishing pad of the polisher, which is out of the semiconductor wafer, while polishing the edge part of the semiconductor wafer; and an ascent/descent device for ascending and descending the support head so as to control a height of the support head;

a height measuring sensor for measuring a height of the support head; and a controller for receiving a height signal of the height measuring sensor and applying a control signal to the ascent/descent device.

15. The apparatus of claim 14, wherein the height measuring sensor is a height measuring camera.

16. The apparatus of claim 14, wherein the support head comprises a conditioning pad which removes foreign substances of the polishing pad of the polisher.

17. The apparatus of claim 14, wherein the support head comprises a de-ionized water (DIW) injection hole which supplies DIW to the polishing pad of the polisher.

18. The apparatus of claim 14, further comprising a rotating device installed between the ascent/descent device and the support head for rotating the support head.

19. The apparatus of claim 14, wherein the spin chuck is a face up type which vacuum adsorbs and supports a non-polished surface of the semiconductor wafer so as for a polished surface of the semiconductor wafer to face upward.

* * * * *